US006526862B1

(12) United States Patent
Lyons

(10) Patent No.: US 6,526,862 B1
(45) Date of Patent: Mar. 4, 2003

(54) FABRIC ARMOR

(75) Inventor: Fielder Stanton Lyons, Phoenix, AZ (US)

(73) Assignee: Simula, Inc., Phoenix, AZ (US)

( * ) Notice: Subject to any disclaimer, the term of this patent is extended or adjusted under 35 U.S.C. 154(b) by 0 days.

(21) Appl. No.: 09/521,613

(22) Filed: Mar. 9, 2000

Related U.S. Application Data

(60) Provisional application No. 60/124,315, filed on Mar. 12, 1999, now abandoned.

(51) Int. Cl.[7] ..... F41H 5/04

(52) U.S. Cl. ..... 89/36.05; 89/36.02; 2/2.5

(58) Field of Search ..... 89/36.05, 36.02; 2/2.5

(56) References Cited

U.S. PATENT DOCUMENTS

| | | | | |
|---|---|---|---|---|
| 4,622,254 A | * | 11/1986 | Nishimura et al. | 428/102 |
| 4,770,918 A | * | 9/1988 | Hayashi | 428/113 |
| 5,175,040 A | | 12/1992 | Harpell et al. | 428/113 |
| 5,327,811 A | | 7/1994 | Price et al. | 89/36.05 |
| 5,343,796 A | * | 9/1994 | Cordova et al. | 89/36.02 |
| 5,456,974 A | | 10/1995 | Lundblad et al. | 428/229 |
| 5,471,905 A | | 12/1995 | Martin | 89/36.02 |
| 5,471,906 A | * | 12/1995 | Bachner, Jr. et al. | 89/36.02 |
| 5,479,659 A | | 1/1996 | Bachner, Jr. | 2/2.5 |
| 5,619,748 A | | 4/1997 | Nelson et al. | 2/2.5 |
| 5,660,913 A | | 8/1997 | Coppage, Jr. | 428/102 |
| 5,677,029 A | | 10/1997 | Prevorsek et al. | 428/113 |
| 5,723,201 A | | 3/1998 | Czetto, Jr. | 428/181 |
| 5,724,670 A | | 3/1998 | Price | 2/2.5 |
| 5,783,278 A | * | 7/1998 | Nishimura et al. | 428/902 |
| 5,960,470 A | * | 10/1999 | Bachner, Jr. | 2/2.5 |
| 5,974,585 A | * | 11/1999 | Bachner, Jr. | 428/911 |
| 6,012,178 A | | 1/2000 | Schuster et al. | 2/2.5 |
| 6,026,509 A | | 2/2000 | Bachner, Jr. | 2/2.5 |
| 6,047,399 A | | 4/2000 | Bachner, Jr. | 2/2.5 |
| 6,131,193 A | * | 10/2000 | Bachner, Jr. | 2/2.5 |
| 6,240,557 B1 | * | 6/2001 | Bachner, Jr. | 2/2.5 |

FOREIGN PATENT DOCUMENTS

| | | | | |
|---|---|---|---|---|
| EP | 585793 | * | 3/1994 | 89/36.05 |

* cited by examiner

*Primary Examiner*—Stephen M. Johnson
(74) *Attorney, Agent, or Firm*—Shaw Pittman LLP

(57) ABSTRACT

A lightweight, ballistic resistant fabric armor constructed of multiple layers of high performance fiber woven fabric arranged in a quasi-isotropic orientation. The fabric armor is used in ballistic resistant garments to cover and protect vital portions of the human body. Used in a garment, the fabric armor is of minimal areal density and bulk while providing flexibility, freedom of movement, ventilation, and an inconspicuous appearance. The fabric armor meets many different global ballistic standards (e.g., the ballistic performance requirements of the National Institute of Justice Standard), with the number of woven fabric layers determined by the level of protection desired.

16 Claims, 4 Drawing Sheets

FABRIC ARMOR

This application claims the priority benefit of U.S. Provisional Application No. 60/124,315, filed Mar. 12, 1999 now abandoned.

The U.S. Government has certain rights in this invention in accordance with the terms of Contract No. N39998-98-C-3562, awarded by the Office of Special Technology.

BACKGROUND

1. Field of the Invention

The present invention relates to ballistic resistant garments, such as soft body armor vests, and a method for constructing the same.

2. Background of the Invention

In the line of duty, law enforcement officers, military personnel, and persons in similarly dangerous occupations require protection against ballistic missiles, such as bullets, shot, shell fragments, knives, and bayonets. Historically, prior art addressing these needs has provided ballistic protection at the expense of mobility, flexibility, and the ability to dissipate heat and moisture. By using heavy and rigid materials, such as steel and plastic, prior art ballistic garments have provided adequate ballistic protection, but with considerable discomfort to the user in terms of weight, thickness, stiffness, and breathability.

Various ballistic performance specifications require different minimum performance requirements to defeat numerous threat types. One example of a ballistic performance specification is National Institute of Justice (NIJ) Standard 0101.03, "Ballistic Resistance of Police Body Armor." This standard classifies body armor into six specific types, by level of ballistic protection performance. The six types, in increasing levels of protection, are Types I, II-A, II, III-A, III, and IV. The first four of these armor levels, Types I, II-A, II, and III-A, protect against handgun threats and are typically soft armor protective vests worn on a regular basis. Types III and IV, on the other hand, are typically hard armor that protects against the highest threats, 308 Winchester full metal jacketed ammunition and armor piercing ammunition, respectively. For each of the six NIJ threat levels, the armor must not only defeat a specified projectile type and number of shots, but also must limit a depth of deformation in a clay backing behind the armor to 44 mm or less.

The NIJ Type I provides protection, for example, against a 38 Special round nose lead bullet impacting at 850 feet/second, and a 22 long rifle high velocity lead bullet impacting at 1050 feet/second. The NIJ Type II-A provides protection, for example, against a 357 Magnum jacketed soft point bullet impacting at 1250 feet/second, and a 9 mm full metal jacketed bullet impacting at 1090 feet/second. The NIJ Type II standard provides protection, for example, against a 357 Magnum impacting at 1395 feet/second, and a 9 mm full metal jacketed bullet impacting at 1175 feet/second.

The NIJ Type III-A armor standard requires the highest protection level for handgun threats. It provides protection, for example, against 44 Magnum lead semi-wadcutter bullets with gas checks, impacting at a velocity of 1400 feet/second or less, and 9 mm full metal jacketed bullets impacting at a velocity of 1400 feet/second or less. An armor satisfying the Type III-A standard also provides protection against the lesser threat levels, Type I, Type II-A, and Type II.

Types III and IV are for high-powered ball and armor piercing projectiles, respectively, and are typically used during tactical operations where higher protection is required. Type III armor protects against 7.62 mm full metal jacketed bullets (U.S. military designation M80) impacting at a velocity of 2750 feet/second or less, while providing protection against the lesser NIJ armor level threats. Type IV armor protects against 30-06 armor piercing rounds impacting at velocity of 2850 feet/second.

Some prior art ballistic resistant garments, in combination with woven material, use reinforced plastic panels that are thick, cumbersome, and hard to conceal. In addition to hindering mobility, this construction creates a safety hazard because assailants may see the ballistic resistant garment and shoot for the head instead. An example of these types of garments are the vests manufactured by Safari Land under the product name Hyper-Lite™, which incorporate panels made of a reinforced plastic hybrid, Spectra Shield™. The Spectra Shield™ panels are less flexible than woven material and result in a vest that is stiff, thick, and uncomfortable to wear. Further, the impermeable plastic does not ventilate and does not dissipate heat or moisture, causing additional discomfort to the user.

Other prior art ballistic resistant garments avoid the rigid reinforced plastic and instead use woven fabric panels exclusively. For example, U.S. Pat. No. 5,479,659 discloses a ballistic resistant garment made of woven fabric that produces a vest that is more flexible, concealable, and wearable than the vests using reinforced plastic. Although this type of woven fabric vest is light compared to the plastic reinforced vests, the vest still burdens the user with a considerable weight per unit area (referred to as areal density), on the order of 1.0 lbs/ft$^2$ for an aramid fabric design vest meeting NIJ Level III-A requirements.

To further reduce areal density but maintain performance, manufacturers use stacked woven fabric made of high performance p-phenylene benzobisoxazole (PBO) fiber, e.g., Zylon® by Toyobo, Inc. Currently, the lightest-weight soft body armor is produced by Second Chance Body Armor, Inc. under the product name Ultima™. In meeting the NIJ standards, Ultima™ areal densities are 0.49 lbs/ft$^2$ for NIJ 0101.03 Type II-A, 0.60 lbs/ft$^2$ for NIJ 0101.03 Type II, and 0.77 for NIJ 0101.03 Type III-A. Although reduced in areal density when compared to other prior art, the Second Chance Ultima™ is still not optimal.

Overall, a ballistic resistant garment should be comfortable to wear on a continuous basis and should provide ballistic protection meeting the applicable standards for its usage. In providing comfort, the ballistic resistant garment should be flexible, should be thin and concealable, should provide adequate ventilation allowing the user to dissipate heat and moisture, and most importantly, should be lightweight to minimize the overall burden on the user. An emphasis on comfort translates directly into improved protection, since comfortable garments will be worn much more often than burdensome garments.

SUMMARY OF THE INVENTION

The present invention is an improved fabric armor for use in ballistic resistant garments. The fabric armor is constructed of high performance fiber fabric arranged in a quasi-isotropic orientation. This quasi-isotropic orientation is more effective in dispersing the impact energy at a minimal areal density in comparison to the prior art methods that simply stack fabric plies.

The first preferred embodiment uses p-phenylene benzobisoxazole (PBO) fibers, such as commercially available as-spun Zylon®-AS, 500-denier. The PBO fiber also provides cut resistance superior to any other high performance fiber.

The second preferred embodiment uses aramid fibers, e.g., Kevlar™, KM2™, or Twaron™.

A third preferred embodiment uses ultra-high molecular weight polyethylene fibers, e.g., Spectra™ or Dyneema™.

Alternating layers of the high performance fiber fabric are positioned in a quasi-isotropic orientation. This orientation produces a garment that weighs less than any previous soft fabric armor, but still provides equivalent ballistic performance in accordance with the velocity and blunt trauma specifications of NIJ Standard 0101.03. The present invention provides ballistic protection equivalent to prior art NIJ Level III-A garments with a significant reduction in areal density, i.e., a greater than 10% reduction in areal density to less than 0.69 lbs/ft$^2$ when using the PBO fiber, when compared to the 0.77 lbs/ft$^2$ Second Chance Ultima™. Along with a reduction in areal density, the improved fabric armor provides the user with a lighter, more flexible, more compact, and more moisture vapor breathable garment.

To achieve the quasi-isotropic orientation, the high performance fiber is woven into a balanced, plain weave fabric, e.g., approximately 25×25 counts/inch and approximately 3.3 oz/yd$^2$. Multiple layers of fabric are combined to create the ballistic filler material for a vest. The number of fabric layers is determined by the ballistic requirement, e.g., the NIJ level required. The individual fabric layers are alternated so that the warp and fill direction of one fabric layer is oriented at a substantially different angle to the warp and fill direction of the second layer. A substantially different angle ranges from 20–70°, in which range examples of suitable angles of orientation include 45°, 22.5°, 30°, 60°, and 67.5°. The positioning of each ply with respect to adjacent plies creates the quasi-isotropic orientation.

As an alternate to positioning fabric layers at angles of orientation, the fabric itself may be formed with its fiber oriented into an angle other than 0/90° to create the quasi-isotropic orientation. This orientation may be accomplished using novel weaving methods or methods other than weaving.

The woven fabric is cut to match the size and shape of each vest component, thereby providing a tailored fit. Fabric cutters cut all of the raw materials for the ballistic filler, covers, and carrier.

The multiple layers of oriented, cut fabric are then preferably quilted through with stitching, e.g., 1 to 2 inch diamond stitching using high performance thread such as Kevlar™. The stitching covers the entire ballistic filler material area of the vest. Although preferred, stitching is not required for the present invention to achieve its intended performance.

The ballistic filler is then placed inside a cover for environmental and ultraviolet protection. The filler and cover are then placed in a fabric vest carrier that is designed to be worn underneath a uniform or shirt for concealable protection. The CoolMax™ by Dupont is an example of a suitable vest carrier fabric that is worn on the inside surface of the carrier, while a poly/cotton blend fabric is typically used for the external surface of the carrier. The carrier is sewn together with adjustable shoulder and side straps. Preferably, the webbing is nylon and the fasteners are all hook and loop.

The invention works in the following manner. The ballistic filler provides the ballistic protection. When a bullet or other projectile strikes the vest, the kinetic energy from the projectile is transferred into the ballistic filler fabric. The quasi-isotropic orientation of the fabric plies provides a widespread dissipation of the energy and greatly reduces blunt trauma. The fibers within the fabric are pulled and the quilting or stitching of the fabric plies further reduces the blunt trauma as defined by the depth of deformation in a clay backing.

Accordingly, it is the object of the present invention to provide ballistic resistant fabric armor of previously unattainable minimum areal density, bulk, and thickness that still meets global ballistic standards, e.g., the NIJ velocity and blunt trauma specifications, Standard 0101.03 Type III-A and lower.

It is another object of the present invention to provide ballistic resistant fabric armor that is flexible, allowing the user to move freely and perform all functions that could be performed without the armor.

It is another object of the present invention to provide a ballistic resistant fabric armor that is well ventilated, breathable, and allows for dissipation of heat and moisture, thereby keeping the user cool and comfortable in hot climates.

It is another object of the present invention to provide a ballistic resistant fabric armor of minimum thickness and bulk such that its use under other garments is inconspicuous.

It is another object of the present invention to provide a woven fabric ballistic resistant armor using any commonly available high performance fibers (e.g., Zylon®, Kevlar™, Twaron™, Spectra™, Dyneema™, or KM2™) arranged in a quasi-isotropic orientation.

It is another object of the present invention to provide a multi-purpose protective garment using puncture and/or cut-resistant fabric armor.

It is also an object of the present invention to provide a ballistic resistant garment that may be stitched through the entire filler, making the garment easier to assemble than the more labor-intensive construction of prior art fillers in which two or more separate filler packets are quilted together. Additionally, the present invention may be used with any stitching method or without stitching entirely, because it functions independently of the stitching method.

These and other objects of the present invention are described in greater detail in the detailed description of the invention, the appended drawings, and the attached claims. Additional features and advantages of the invention. will be set forth in the description that follows, will be apparent from the description, or may be learned by practicing the invention.

DETAILED DESCRIPTION OF THE INVENTION

Figure 1:
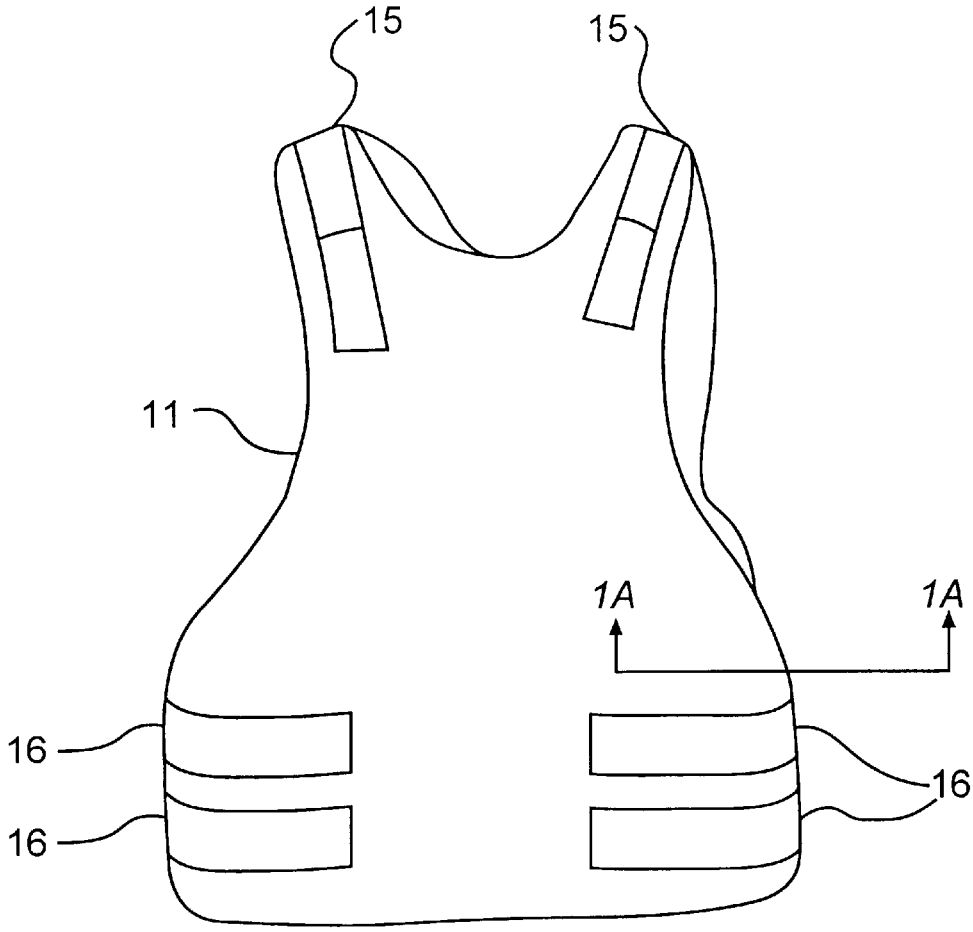
FIG. 1 is a schematic diagram of the ballistic resistant garment.
Figure 1A:
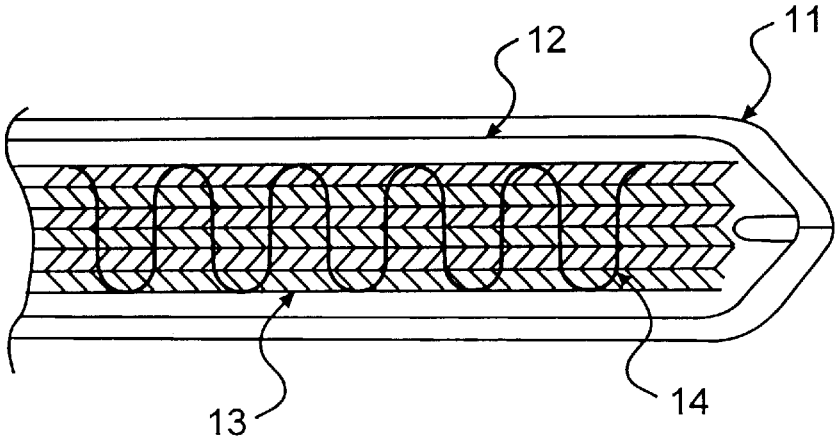
FIG. 1A is a schematic diagram of a cross section of the ballistic resistant garment shown in FIG. 1, along line 1A—1A.

FIGS. 1 and 1A are schematic diagrams of the primary components of the ballistic resistant garment including an outer vest carrier 11, a protective cover 12 or the ballistic filler, a ballistic filler 13, and fiber stitching 14. Examining the construction from the inside out, the ballistic filler 13 is held together by fiber stitching 14 and is contained in the protective cover 12, which in turn is contained in the outer vest carrier 11.

The outer vest carrier 11 is sewn together with adjustable shoulder straps 15 and side straps 16. In the preferred embodiment, the vest carrier webbing is nylon and all fasteners are hook and loop.

The ballistic filler cover 12 is preferably made of lightweight, waterproof material to protect the ballistic filler 13 from environmental damage (e.g., sweat, body oils, petrochemical spills, and ultraviolet light).

Figure 2:
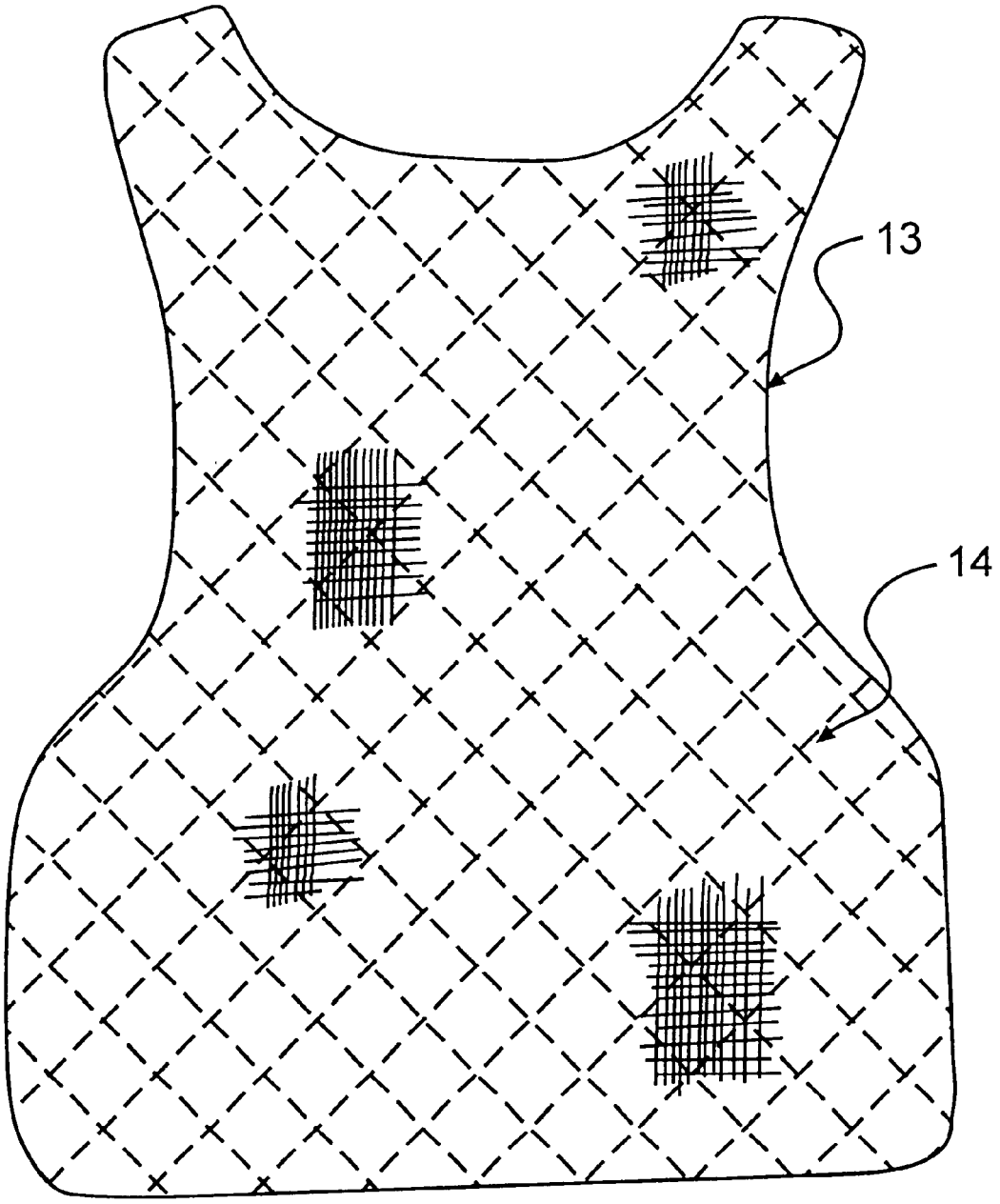
FIG. 2 is a schematic diagram of the ballistic filler.

FIG. 2 illustrates the ballistic filler 13 cut into the shape of a vest and held together by fiber stitching 14 in a diamond pattern, preferably about 1" to 2" wide diamonds with 90° corners.

Figure 3:
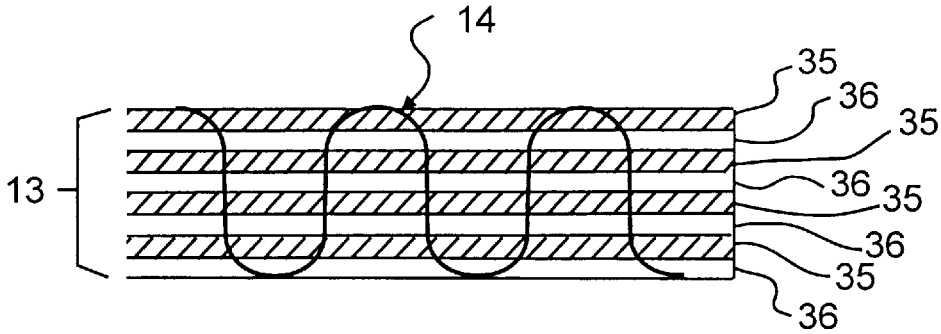
FIG. 3 is a schematic diagram of a cross-sectional view of the ballistic filler.
Figure 3A:
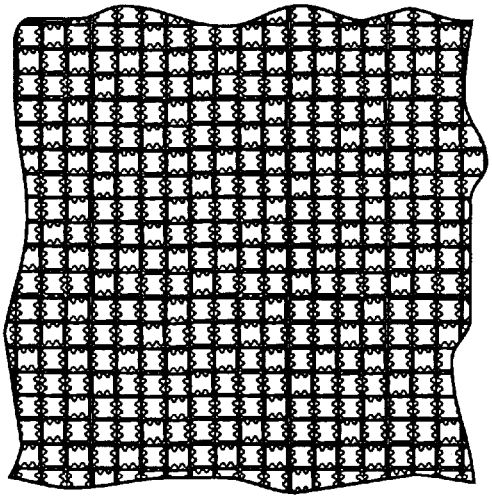
FIG. 3A is a schematic diagram of a plan view of a fabric ply of the ballistic filler.
Figure 3B:
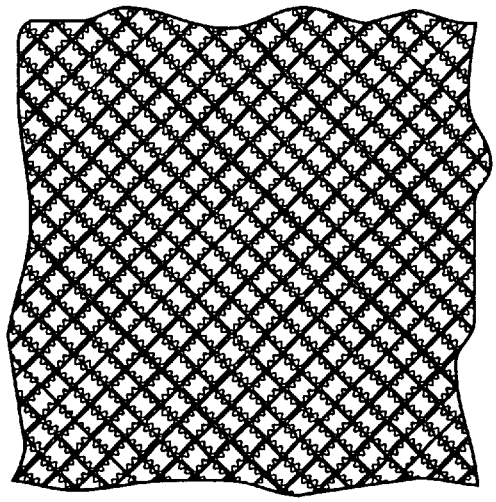
FIG. 3B is a schematic diagram of a plan view of a fabric ply of the ballistic filler.

FIGS. 3, 3A, 3B, and 3C illustrate the quasi-isotropic, multiple layer construction of the ballistic filler 13. FIG. 3 is a schematic diagram of a cross-sectional view of the ballistic filler, showing the alternating plies 35 and 36 held together by stitching 14. FIG. 3A shows a 0/90° ply 35, with the warp and fill direction of the fabric ply at 0° and 90°. FIG. 3B shows a −45/+45° ply 36, with the warp and fill direction of the fabric ply at −45° and +45°. Both the 0/90° ply 35 and the −45/+45° ply 36 are constructed of high performance fibers woven into a balanced, plain weave.

Figure 3C:
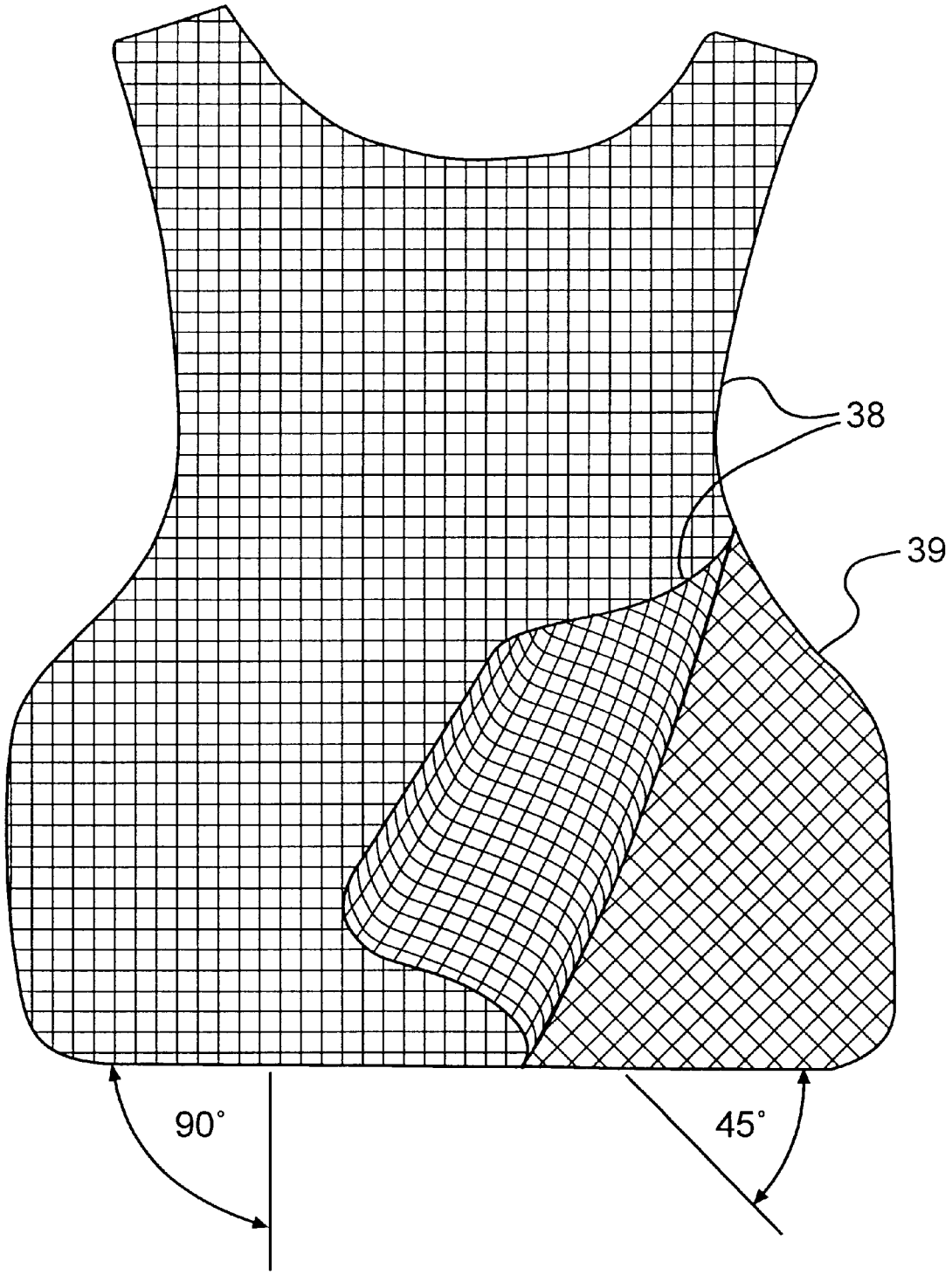
FIG. 3C is a schematic diagram of fabric plies of the ballistic filler assembled in quasi-isotropic orientation as a vest.

FIG. 3C shows an example of how the fabric plies are assembled in quasiisotropic orientation in a vest. Each fabric ply is oriented at 45° with respect to an adjacent ply. As shown in FIG. 3C, the first ply 38 is oriented with the warp fibers in the 0° position and the second ply 39 has the warp fibers in the 45° position. Although not shown, a third ply would have the warp fibers back in the 0° position and this pattern would repeat through multiple layers.

In the preferred embodiment, the resulting woven fabric is approximately 25×25 counts/inch and approximately 3.3 oz/yd$^2$. Fabric heavier than 3.3 oz/yd$^2$ can be used, but performance tends to decrease as the weight of the fabric increases. Fabric lighter than 3.3 oz/yd$^2$ can be used, but requires the added cost of more layers and creates difficulties in handling the increased number of layers without damaging the weave.

As shown in FIGS. 3 and 3C, the individual fabric plies are stacked so that the warp and fill direction of the 0/90° ply 35 is oriented at a 45° angle to the warp and fill direction of the −45/+45° ply 36. The alternating warp and fill directions create the quasi-isotropic orientation of the fabric plies.

In the preferred embodiment, the angle of orientation is 45°. However, other suitable angles include, but are not limited to, 22.5°, 30°, 60°, and 67.5°. In addition, incremental angles of orientation could be used to optimize the response of the particular high performance fiber used.

In FIG. 3, the number of alternating ply layers is shown for illustration purposes only. The exact number of fabric layers is determined by the applicable ballistic specification, e.g., the required NIJ Type. Using a PBO fiber such as Zylon®, the present invention requires a minimal number of plies, and therefore a minimal areal density, to achieve the applicable global protection standard, e.g., the NIJ standards. For example, to provide Type II-A protection, the present invention requires approximately 19 plies in quasi-isotropic orientation, at an areal density of about 0.44 lbs/ft$^2$. To provide Type II protection, the present invention requires approximately 23 plies in quasi-isotropic orientation, at an areal density of about 0.53 lbs/ft$^2$. Finally, to provide Type III-A protection, the present invention requires about 30 plies in quasi-isotropic orientation, at an areal density of about 0.69 lbs/ft$^2$. In addition, depending on the quality of the fiber, the weave, and the stitching, the present invention could meet each protection level with about as many as three fewer plies, making the areal density ranges for each level as follows: approximately 0.37–0.44 lbs/ft$^2$ for Type II-A; approximately 0.46–0.53 lbs/ft$^2$ for Type II; and approximately 0.62–0.69 lbs/ft$^2$ for Type III-A. Thus, the present invention provides clear advantages over the prior art in minimizing fabric armor areal density and thickness.

A recent test by an NIJ certified laboratory illustrates a specific example of the superior performance of the present invention in comparison to the prior art. The laboratory tested both the present invention and a prior art design in accordance with NIJ 0101.03 for level III-A. Table: 1 below summarizes the results as follows:

TABLE 1

| | | 9-mm Full Metal Jacketed | | 44 Magnum | |
|---|---|---|---|---|---|
| Armor Design | Areal Density (lbs/ft$^2$) | Avg BFS* (mm) | Avg $V_{50}$** (ft/s) | Avg BFS* (mm) | Avg $V_{50}$** (ft/s) |
| Present Invention | 0.69 | 26 | 1808 | 34 | 1756 |
| 8$^{th}$ Generation Second Chance Ultima | 0.77 | 26 | 1758 | 36 | 1635 |

*Avg BFS (Back Face Signature) = average of four 1$^{st}$ shot clay deformation measurements
Avg $V_{50}$ = average of two $V_{50}$ velocity tests Once the fabric plies are stacked and cut into the garment pattern, the plies are preferably stitched together to make up the ballistic filler 13. FIG. 2 shows the fully constructed ballistic filler 13, with the multiple layers of fabric ply stitched together. The stitching can be any suitable high performance fiber, such as p-phenylene benzobisoxazole, aramid, and ultra-high molecular weight polyethylene. In the preferred embodiment, the stitching 14 is high performance Kevlar™ thread, in an approximately 1" to 2" diamond pattern, with the corners of the diamonds at 90° angles. As shown in FIG. 2, the stitching 14 covers the entire area of ballistic filler 13**. Preferably, the fabric plies are stitched together over the entire surface of the armor using a Kevlar™ size FF thread at 8–9 stitches per inch. However, other stitching techniques, such as those which provide higher flexibility, may be employed to improve the wearability of the garment. In addition, the plies of the present invention do not have to be stitched at all to satisfy performance objectives.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A ballistic resistant armor comprising at least two layers of fabric, wherein each layer of the at least two layers has a warp and fill direction at an angle substantially different from an adjacent warp and fill direction of an adjacent layer of the at least two layers, and wherein the at least two layers have an areal density of approximately 0.37–0.48 lbs/ft$^2$ and defeat one of a 357 Magnum jacketed soft point bullet impacting at 1250 feet/second and a 9 mm full metal jacketed bullet impacting at 1090 feet/second, with a depth of deformation in a clay backing behind the ballistic resistant armor limited to 44 mm or less.

2. The ballistic resistant armor of claim 1, wherein the at least two layers are attached together with stitching.

3. The ballistic resistant armor of claim 2, wherein the stitching is in a diamond pattern, wherein each diamond of the diamond pattern is approximately 1" to 2" wide.

4. The ballistic resistant armor of claim 3, wherein the stitching is a fiber selected from the group consisting essentially of p-phenylene benzobisoxazole, aramid, and polyethylene.

5. The ballistic resistant garment of claim 1, wherein the at least two layers of fabric are made from a fiber selected from the group consisting essentially of p-phenylene benzobisoxazole, aramid and polyethylene.

6. The ballistic resistant armor of claim 1, wherein the substantially different angle is from 20–70°.

7. The ballistic resistant armor of claim 1, wherein the substantially different angle varies incrementally between layers of the at least two layers to optimize ballistic resistance of a particular fiber.

8. The ballistic resistant armor of claim 1, wherein fibers of the adjacent layer of the at least two layers are formed into an angle other than 0/90° to provide the substantially different angle.

9. The ballistic resistant armor of claim 1, wherein the first layer and the second layer are breathable.

10. A ballistic resistant armor comprising at least two layers of fabric, wherein each layer of the at least two layers has a warp and fill direction at an angle substantially different from an adjacent warp and fill direction of an adjacent layer of the at least two layers, and wherein the at least two layers have an areal density of approximately 0.46–0.59 lbs/ft$^2$ and defeat one of a 357 Magnum impacting at 1395 feet/second and a 9 mm full metal jacketed bullet impacting at 1175 feet/second, with a depth of deformation in a clay backing behind the ballistic resistant armor limited to 44 mm or less.

11. The ballistic resistant garment of claim 10, wherein the at least two layers of fabric are made from a fiber selected from the group consisting essentially of p-phenylene benzobisoxazole, aramid, and polyethylene.

12. The ballistic resistant armor of claim 10, wherein the substantially different angle varies incrementally between layers of the at least two layers to optimize ballistic resistance of a particular fiber.

13. A ballistic resistant armor comprising at least two layers of fabric, wherein each layer of the at least two layers has a warp and fill direction at an angle substantially different from an adjacent warp and fill direction of an adjacent layer of the at least two layers, and wherein the at least two layers have an areal density of approximately 0.62–0.76 lbs/ft$^2$ and defeat one of a 44 Magnum lead semi-wadcutter bullet with gas check impacting at a velocity of 1400 feet/second and a 9 mm full metal jacketed bullet impacting at a velocity of 1400 feet/second, with a depth of deformation in a clay backing behind the ballistic resistant armor limited to 44 mm or less.

14. The ballistic resistant garment of claim 13, wherein the at least two layers of fabric are made from a fiber selected from the group consisting essentially of p-phenylene benzobisoxazole, aramid, and polyethylene.

15. The ballistic resistant armor of claim 13, wherein the substantially different angle varies incrementally between layers of the at least two layers to optimize ballistic resistance of a particular fiber.

16. A ballistic resistant armor comprising at least two layers of fabric, wherein each layer of the at least two layers has a warp and fill direction at an angle substantially different from an adjacent warp and fill direction of an adjacent layer of the at least two layers, wherein the at least two layers are a balanced, plain weave fabric wherein the balanced, plain weave fabric is approximately 25×25 counts/inch and approximately 3.3 oz/yd$^2$.

* * * * *